US006085715A

United States Patent [19]

Walker

[11] Patent Number: 6,085,715

[45] Date of Patent: Jul. 11, 2000

[54] TAMPER RESISTANT GOVERNOR CONTROL ROD COVER

[76] Inventor: Bruce H. Walker, 5010 Whispering Oaks Dr., Linden, Mich. 48451

[21] Appl. No.: 09/260,277

[22] Filed: Mar. 2, 1999

Related U.S. Application Data

[60] Provisional application No. 60/076,620, Mar. 3, 1998.

[51] Int. Cl.[7] ..... F02F 7/00

[52] U.S. Cl. ..... 123/195 C; 123/195 A

[58] Field of Search ..... 123/195 A, 195 C, 123/198 E

[56] References Cited

U.S. PATENT DOCUMENTS 3,893,441 7/1975 Hebb, Jr. et al. ..... 123/195 C

*Primary Examiner*—Noah P. Kamen
*Assistant Examiner*—Katrina Harris
*Attorney, Agent, or Firm*—Howard & Howard

[57] ABSTRACT

A cover is provided which partially covers a governor control rod of a small engine. The cover mounts to a portion of an engine housing. The cover prevents a user from tampering with the governor control rod on a small engine.

20 Claims, 4 Drawing Sheets

TAMPER RESISTANT GOVERNOR CONTROL ROD COVER

This application claims the benefit of U.S. Provisional Application No. 60/076,620, filed Mar. 3, 1998.

BACKGROUND OF THE INVENTION

This invention relates generally to small engines and, more particularly, to a tamper resistant cover for a governor control rod within a small engine. The tamper resistant cover of the present invention prevents users of the small engine from bending the governor control rod and thereby overriding the limitation on engine speed afforded by a governor mechanism.

Many small engines, for instance those found in golf carts, include a governor mechanism for limiting the speed of the engine. In a conventional small engine, the governor mechanism includes a control rod that connects the governor mechanism to the throttle and limits the allowed advancement of the throttle to thereby limit the top speed of the engine. In a typical small engine, this control rod is accessible to a user of the small engine. Frequently, users of the small engine will bend or shorten this control rod in a manner that permits an increase in the top end speed for the engine. This is particularly common among users of golf carts at public golf courses.

Disabling the governor mechanism by bending or shortening the control rod may result in a number of problems for the owner of the engine. First, the increased top end speed may cause damage to the engine itself. Second, if the engine is mounted in a vehicle, accidents are more frequent and costly when the governor mechanism has been disabled. Frequently, the accidents cause extensive damage to the vehicle body and vehicle components. Third, disabling the governor mechanism may lead to a rejection of insurance coverage should an accident result with a vehicle that has a disabled governor mechanism.

Therefore, it is desirable to provide an inexpensive device to prevent tampering with the governor mechanism. Secondly, it is desirable to provide a tamper resistance device that can be installed in aftermarket applications on existing small engines.

SUMMARY OF THE INVENTION

The present invention overcomes the problems associated with typical small engine governor mechanisms by providing a cover that encloses the governor control rod. The cover can be rapidly installed using pre-existing connection points commonly found on existing small engine designs. The cover includes a top side having a first edge and a second edge with the second edge having a contour; a bottom side having a first edge and a second edge, with the second edge having a contour; a side member joins the top side to the bottom side; a first bracket is mounted on the top side adjacent a first end of the cover; a second bracket is mounted on the top side adjacent a second end of the cover; and a hole located in the first bracket mounts the cover to an engine housing and a hole in the second bracket mounts the cover to an engine housing. The top side, side member, and bottom side define an internal space for receiving the governor control. The cover is designed to be adapted to a wide variety of small engine designs.

DETAILED DESCRIPTION OF THE PREFERRED EMBODIMENT

Figure 1:
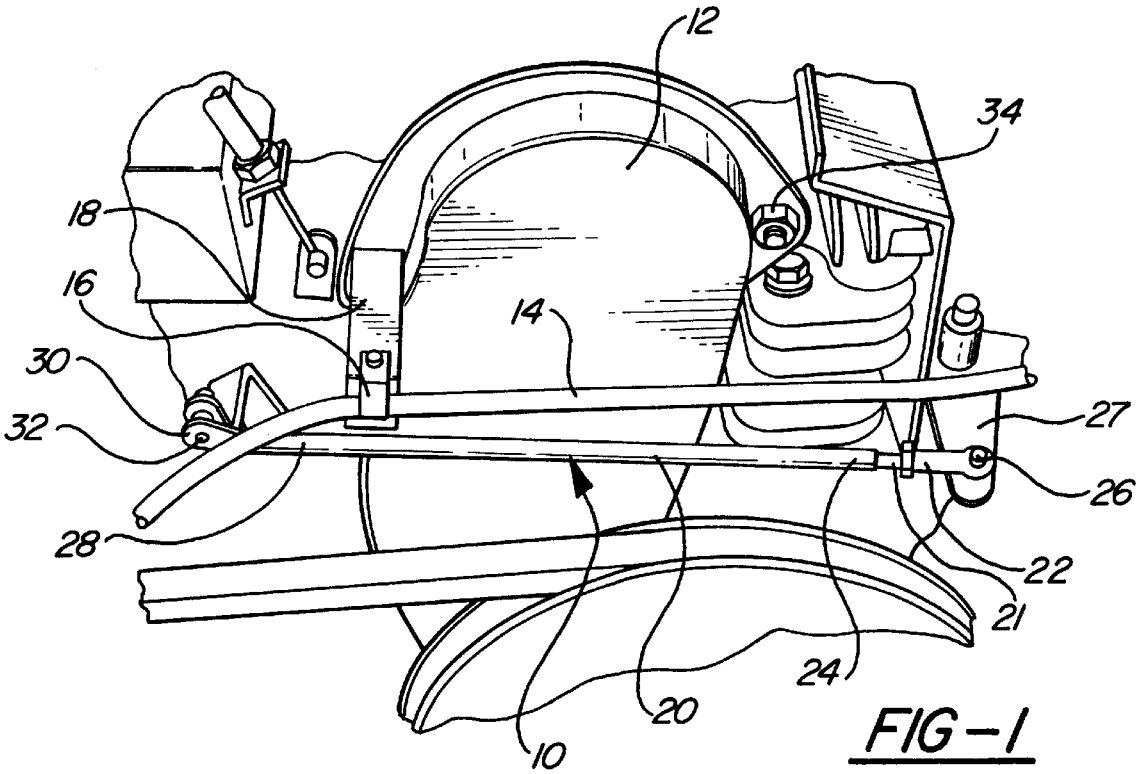
FIG. 1 is a side perspective view of a portion of a small engine and its governor control rod.

Referring to the figures wherein like numerals indicate like or corresponding parts through the several views, in FIG. 1 a governor control rod is shown generally at 10. A belt housing 12 is located adjacent to the governor control rod 10. A throttle cable 14 is located above the governor control rod 10. A securing member 16 secures the throttle cable 14 to a throttle cable bracket 18.

Figure 2:
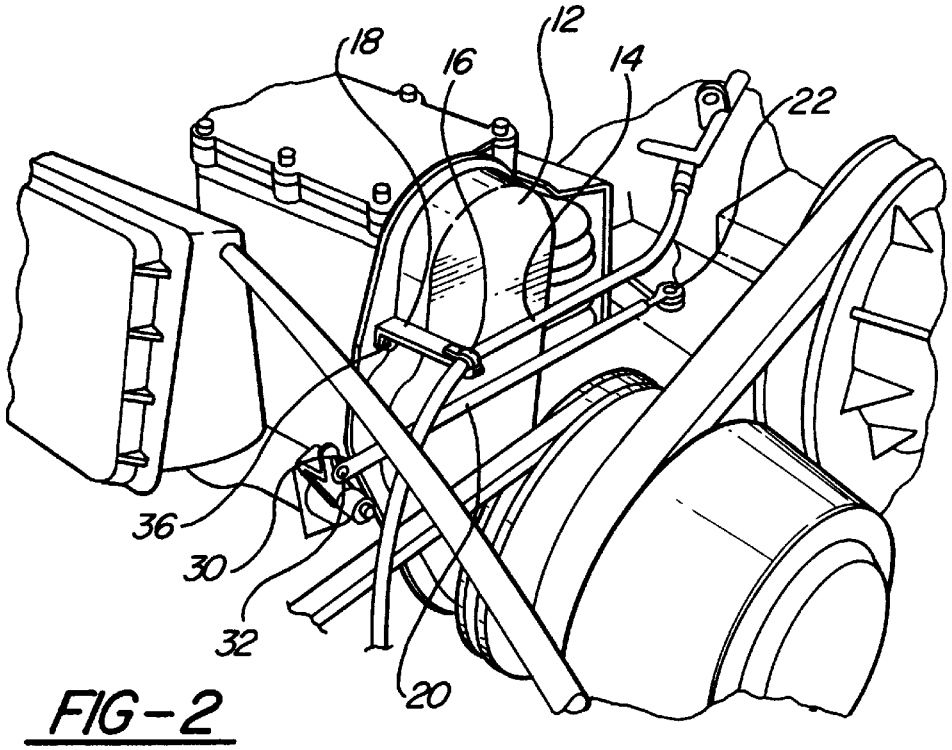
FIG. 2 is a second side perspective view of the view shown in FIG. 1.

The governor control rod 10 shown includes a sleeve 20 that covers a portion of a linkage rod 21. A first rod end 22 is secured to a first end 24 of the control rod 10. The first rod end 22 is coupled to a first ball stud 26, which is secured to a governor linkage member 27. A second end 28 of the control rod 10 includes a second rod end 30. The second rod end 30 is coupled to a second ball stud 32. A mounting hole 34 is located within a portion of the belt housing 12. As shown in FIG. 2, a bolt 36 secures the throttle cable bracket 18 to the belt housing 12. The governor control rod 10 is of a typical design and will be understood by one of ordinary skill in the art. In practice, if a user bends the control rod 10 upwardly toward the throttle cable 14, the governor mechanism (not shown) is disabled and the top end speed of the small engine is increased. An alternative governor control rod (not shown) design is to form the governor control rod from two rods that are joined by a flexible joint. This alternative is designed to prevent users from creating a permanent bend in the rod as discussed above. Users disable this two piece governor control rod by drawing one end of each rod toward each other with a piece of wire or string. The present invention also prevents tampering with this alternative governor control rod design.

Figure 3:
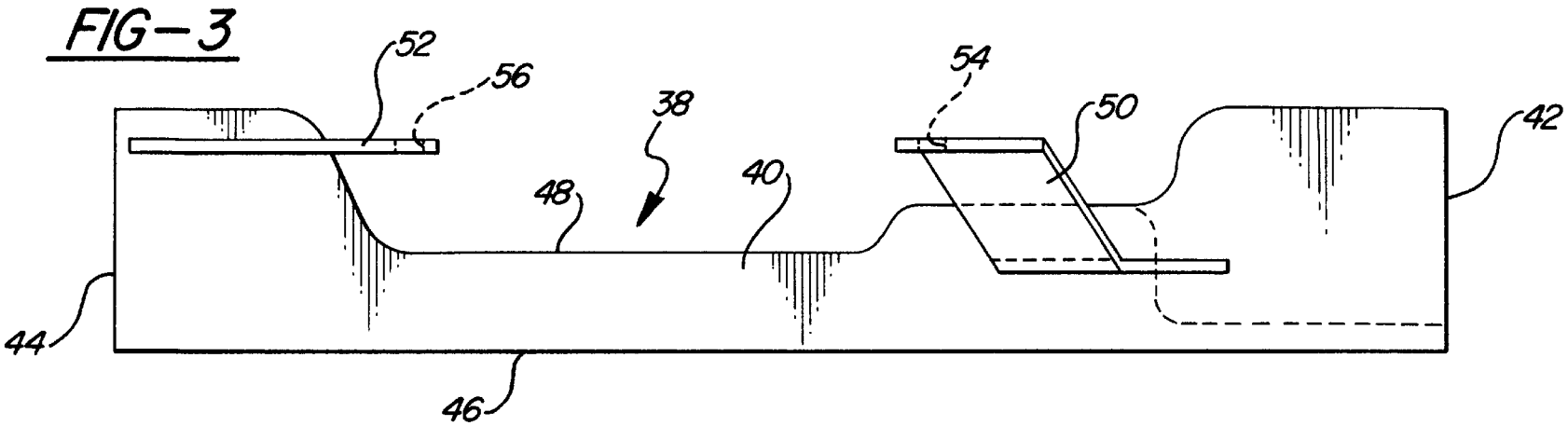
FIG. 3 is a top plan view of a cover designed in accordance with the present invention.
Figure 4:
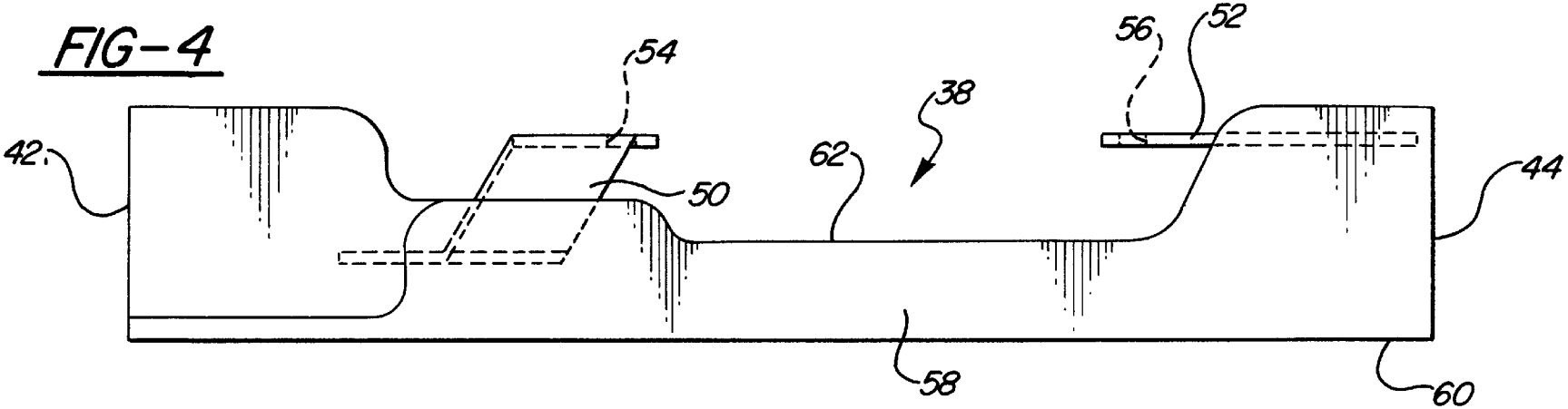
FIG. 4 is a bottom plan view of the cover shown in FIG. 3.
Figure 5:
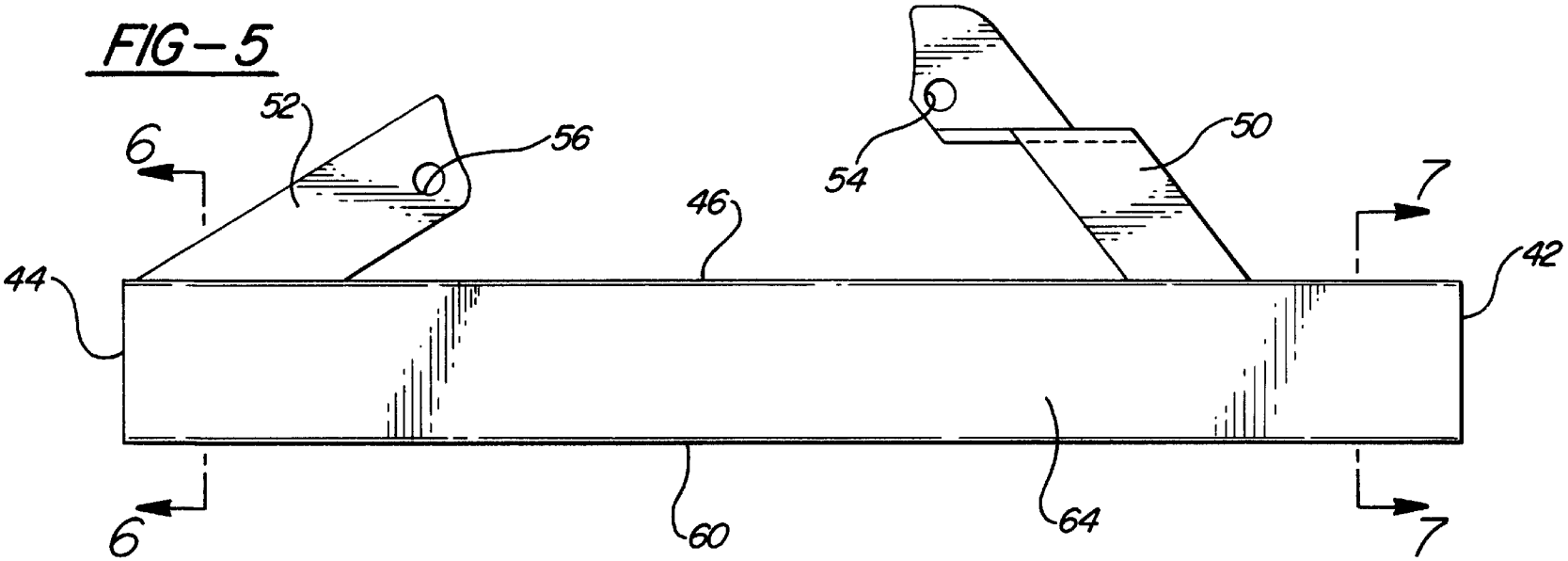
FIG. 5 is a side view of the cover shown in FIG. 3.

In FIG. 3, a top plan view of a cover is shown generally at 38. The cover 38 includes a top side 40, a first end 42 and a second end 44. The top side 40 includes a first edge 46 having a substantially straight contour and a second edge 48 having a contour adapted to accommodate a portion of the belt housing 12. A first bracket 50 is mounted on the top side 40 adjacent the first end 42. The first bracket 50 is shown having a Z shape. The particular shape is determined by the position of the mounting hole 34 relative to the governor mechanism 10. A second bracket 52 is mounted on the top side 40 adjacent the second end 44. A hole 54 is located in the first bracket 50. A hole 56 is located in the second bracket 52. FIG. 4 is a bottom plan view of the cover 38 shown in FIG. 3. Cover 38 includes a bottom side 58 having a first edge 60 and a second edge 62. The first edge 60 has a substantially straight contour and the second edge 62 has a contour adapted to accommodate a portion of the belt housing 12. As shown in FIG. 5, a side member 64 joins the first edge 46 of the top side 40 to the first edge 60 of the bottom side 58.

Figure 7:
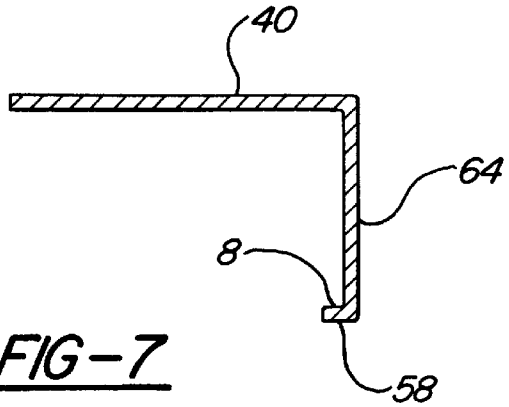
FIG. 7 is a cross-sectional end view along lines 7—7 of FIG. 5.
Figure 6:
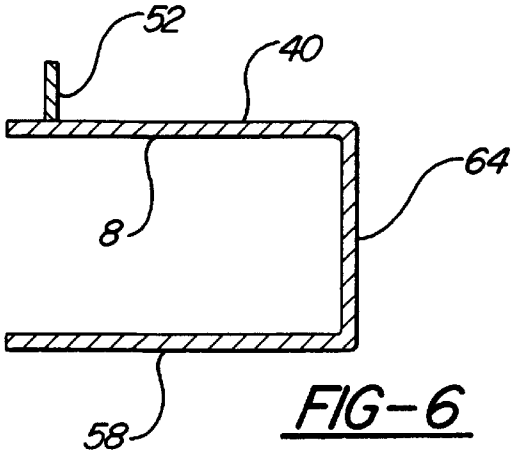
FIG. 6 is a cross-sectional end view along lines 6—6 of FIG. 5.

FIG. 6 is a cross-sectional end view along lines 6—6 of FIG. 5. FIG. 7 is a cross-sectional end view along lines 7—7 of FIG. 5. An internal space 8 is defined by the top side 40, side member 64, and bottom side 58. The internal space 8 receives the governor control rod 10.

Figure 8:
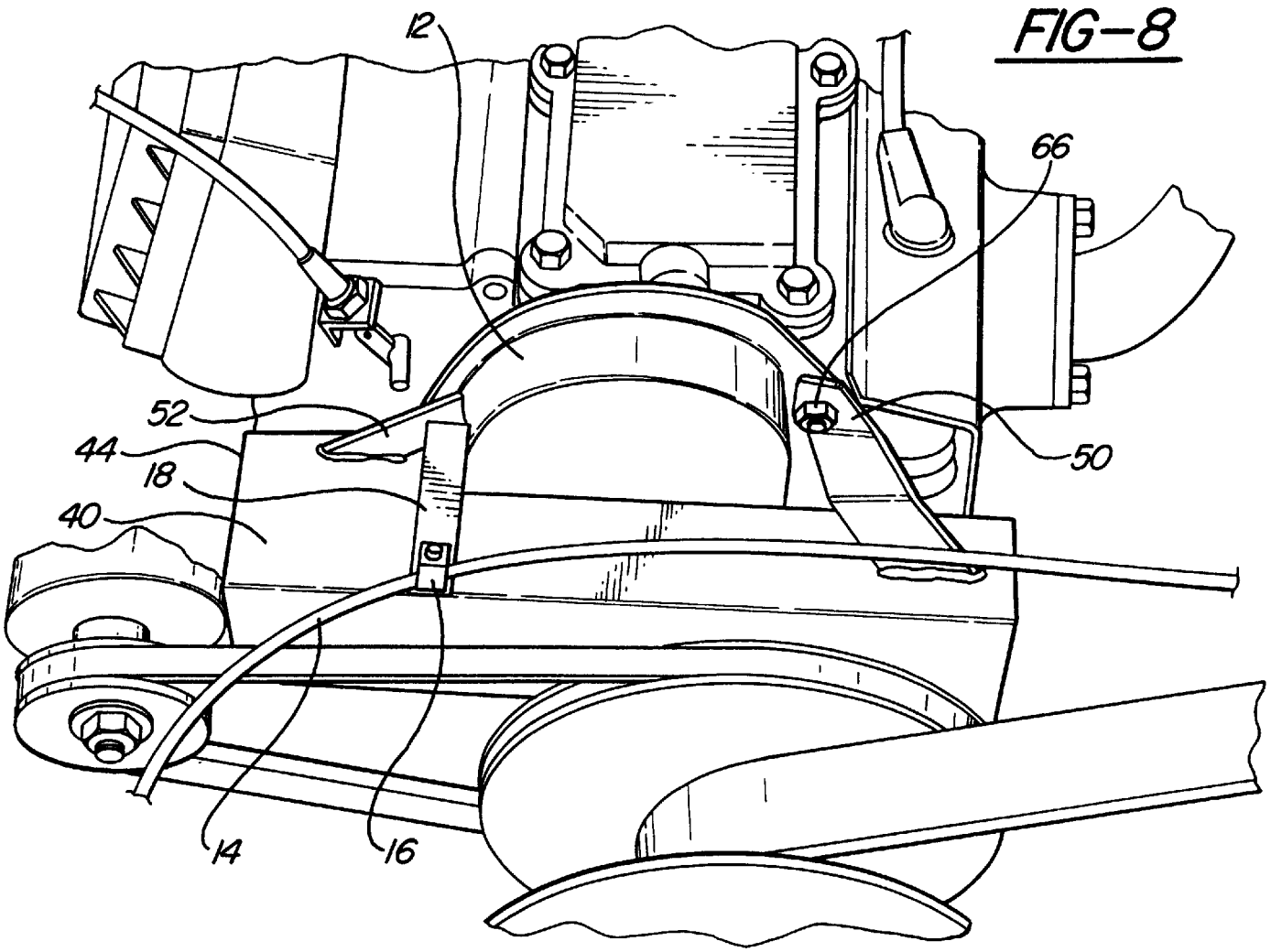
FIG. 8 is a top plan perspective view of a small engine with the cover designed according to the present invention in place.

FIG. 8 is a top plan perspective view of the cover 38 in place around the governor control rod 10. A bolt 66 passes through the hole 54 and is received in mounting hole 34 to secure the first bracket 50 to the belt housing 12. The second bracket 52 is located adjacent the throttle cable bracket 18. Bolt 36 passes through the throttle cable bracket 18, through hole 56 and secures the second bracket 52 to the belt housing 12. The top side 40 of the cover 38 covers a portion of the governor control rod 10. The side member 64 and the bottom side 58 also cover a portion of the governor control rod 10.

As will be understood by one of ordinary skill in the art, the contour of the second edge 48 of the top side 40 and the contour of the second edge 62 of the bottom side 58 may be varied from that as shown in order to accommodate variations in the shape of the belt housing 12 or the cover 38 may be mounted to an engine housing other than the belt housing 12. In addition, the location of the first bracket 50 and the second bracket 52 may be varied according to the position of mounting hole 34 and bolt 36. The shape of the first bracket 50 and the second bracket 52 may also be varied. The shape of the internal space 8 may also be varied to accommodate differently shaped governor control rods 10.

As would be understood by one of ordinary skill in the art, cover 38 could also be designed to only comprise top side 40 having first bracket 50 and second bracket 52. Thus, in this embodiment the cover 38 would also prevent upward bending of governor control rod 10 without the need for bottom side 58 or side member 64. Likewise, cover 38 could be fabricated with only top side 40 having first bracket 50 and second bracket 52 and side member 64.

The foregoing description is exemplary rather than limiting in nature. Variations and modifications to the disclosed embodiment may become apparent to those skilled in the art and do come within the scope of this invention.

What is claimed is:

1. A cover for a governor control rod, said cover comprising:

a top side having a first bracket mounted on said top side adjacent a first end of said cover and a second bracket mounted on said top side adjacent a second end of said cover; and said first bracket and said second bracket adapted to secure said cover to a portion of an engine thereby orienting said top side over the governor control rod.

2. A cover as recited in claim 1 wherein said first bracket and said second bracket each include an opening said openings permitting said cover to be secured to a portion of an engine by a plurality of bolts.

3. A cover as recited in claim 1 wherein said second bracket has a generally flat and planar shape.

4. A cover as recited in claim 1 wherein said first bracket has a shape comprising a first leg, a second leg, and a third leg;

said first leg oriented generally parallel to said third leg; and said second leg oriented generally perpendicular to said first leg and said third leg.

5. A cover as recited in claim 1 wherein said top side includes a first edge opposite a second edge and said cover further comprising a side member, said side member extending from said first edge of said top side and being generally perpendicular to said top side.

6. A cover as recited in claim 5 further comprising a bottom side joined to said top side by said side member.

7. A cover as recited in claim 6 wherein said bottom side is oriented generally parallel to said top side and said side member is generally perpendicular to said top side and said bottom side.

8. A cover for a governor control rod, said cover comprising:

a top side including a first edge opposite a second edge;

a first bracket mounted on said top side adjacent a first end of said cover and a second bracket mounted on said top side adjacent a second end of said cover;

a bottom side including a first edge opposite a second edge;

a side member joining said top side to said bottom side;

said top side, bottom side, and side member defining an internal space for receiving a governor control rod; and said first bracket and said second bracket adapted to secure said cover to a portion of an engine with said top side oriented over the governor control rod.

9. A cover as recited in claim 8 wherein said side member is connected to both said first edge of said top side and said first edge of said bottom side, said top side being generally parallel to said bottom side and said side member being generally perpendicular to said top side and said bottom side.

10. A cover as recited in claim 8 wherein said first bracket and said second bracket each include an opening permitting said cover to be secured to a portion of an engine by a plurality of bolts.

11. A cover as recited in claim 10 wherein said opening in first bracket and said second bracket permit said cover to be secured to an engine housing by a plurality of engine housing bolts.

12. A cover as recited in claim 11 wherein said second edge of said top side includes a contour, said contour adapted to generally follow a contour of the engine housing.

13. A cover as recited in claim 11 wherein said second edge of said bottom side includes a contour, said contour adapted to generally follow a contour of the engine housing.

14. A cover as recited in claim 8 wherein said second bracket has a generally flat and planar shape.

15. A cover as recited in claim 8 wherein said first bracket has a shape comprising a first leg, a second leg, and a third leg;

said first leg oriented generally parallel to said third leg; and said second leg oriented generally perpendicular to said first leg and said third leg.

16. A cover for a governor control rod, said cover comprising:

a top side including a first edge opposite a second edge;

a first bracket mounted on said top side adjacent a first end of said cover and a second bracket mounted on said top side adjacent a second end of said cover;

a bottom side including a first edge opposite a second edge;

a side member joining said top side to said bottom side;

said top side, bottom side, and side member defining an internal space for receiving a governor control rod; and said first bracket and said second bracket securing said cover to a portion of an engine with said top side oriented over said governor control rod.

17. A cover as recited in claim 16 wherein said side member is connected to both said first edge of said top side and said first edge of said bottom side, said top side being generally parallel to said bottom side and said side member being generally perpendicular to said top side and said bottom side.

18. A cover as recited in claim 16 wherein said first bracket and said second bracket each are secured to an engine housing by a plurality of housing bolts.

19. A cover as recited in claim 18 wherein said second edge of said top side includes a contour and wherein said second edge of said bottom side includes a contour, said contours generally following a contour of said engine housing.

20. A cover as recited in claim 16 wherein said first bracket has a generally flat and planar shape and wherein said second bracket has a shape comprising a first leg, a second leg, and a third leg;

said first leg oriented generally parallel to said third leg; and said second leg oriented generally perpendicular to said first leg and said third leg.

* * * * *